United States Patent [19]

Chou

[11] Patent Number: 4,694,986

[45] Date of Patent: Sep. 22, 1987

[54] DISPOSABLE CONTAINER

[76] Inventor: Lung-Chiao Chou, No. 1, Alley 9, Lane 250, Sec. 2, Cheng Kung Rd., Nei Hu, Taipei, Taiwan

[21] Appl. No.: 896,647

[22] Filed: Aug. 15, 1986

[51] Int. Cl.[4] ..... B65D 5/36

[52] U.S. Cl. ..... 229/41 R; 229/41 B; 229/23 R; 229/1.5 B

[58] Field of Search ..... 229/41 R, 41 B, 23 R, 229/1.5 B, 1.5 H

[56] References Cited

U.S. PATENT DOCUMENTS

| | | | |
|---|---|---|---|
| 680,186 | 8/1901 | Van Wormer | 229/41 R |
| 683,532 | 10/1901 | Wagnitz | 229/41 B |
| 1,175,160 | 3/1916 | McDonald | 229/41 B |
| 1,509,454 | 9/1924 | Unser | 229/41 B |
| 1,985,990 | 1/1935 | Hanson | 229/41 B |
| 2,697,545 | 12/1954 | Radin | 229/41 B |
| 4,335,830 | 6/1982 | Garganese | 229/41 B |
| 4,406,380 | 9/1983 | Paige | 229/41 B |

FOREIGN PATENT DOCUMENTS

| | | | |
|---|---|---|---|
| 10771 | of 1891 | United Kingdom | 229/41 B |

*Primary Examiner*—Willis Little

*Attorney, Agent, or Firm*—Sherman and Shalloway

[57] ABSTRACT

This invention relates to a disposable container and in particular to one having an inner cup provided with a vertical front wall, a vertical rear wall, two vertical side walls and a bottom, and an outer cup provided with a bottom plate and four flaps extending from respective sides thereof. The inner cup is adhered to the outer cup and has folding lines to enable the inner cup together with the outer cup to be folded into a sheet. Further, a pulling line is passed through the upper edges of the inner cup and outer cup so that when the pulling line is pulled, the sheet will be pulled open to form a container.

2 Claims, 6 Drawing Figures

DISPOSABLE CONTAINER

BACKGROUND OF THE INVENTION

This invention relates to a novel disposable container, and in particular to one which may be disposed of after use and collapsible thereby enabling it to be carried conveniently.

Presently, all kinds of cups including paper cups, plastic cups, porcelain cups, glasses, stainless cups, etc., have fixed shapes. In short, they cannot be reduced in volume even when not in use. Thus, they will occupy large amount of space in conveyance and therefore, will have high cost of transportation. Furthermore, they are easily broken during transportation. In other words, it is inconvenient to carry about for picnic, outing, travelling, etc.

It is, therefore, an object of the present invention to provide an improved disposable container which may obviate and mitigate the above-mentioned drawbacks.

SUMMARY

It is the primary object of the present invention to provide a disposable container which is collapsible.

It is another object of the present invention to provide a disposable container which is collapsible.

It is still another object of the present invention to provide a disposable container which is convenient to carry about.

It is still another object of the present invention to provide a disposable container which is inexpensive in transportation.

It is still another object of the present invention to provide a disposable container which is easy for stowage.

It is a further object of the present invention to provide a disposable container which is very cheap in packaging.

DETAILED DESCRIPTION OF THE PREFERRED EMBODIMENT

Before explaining the present invention in detail, it is to be understood that the invention is not limited in its application and the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
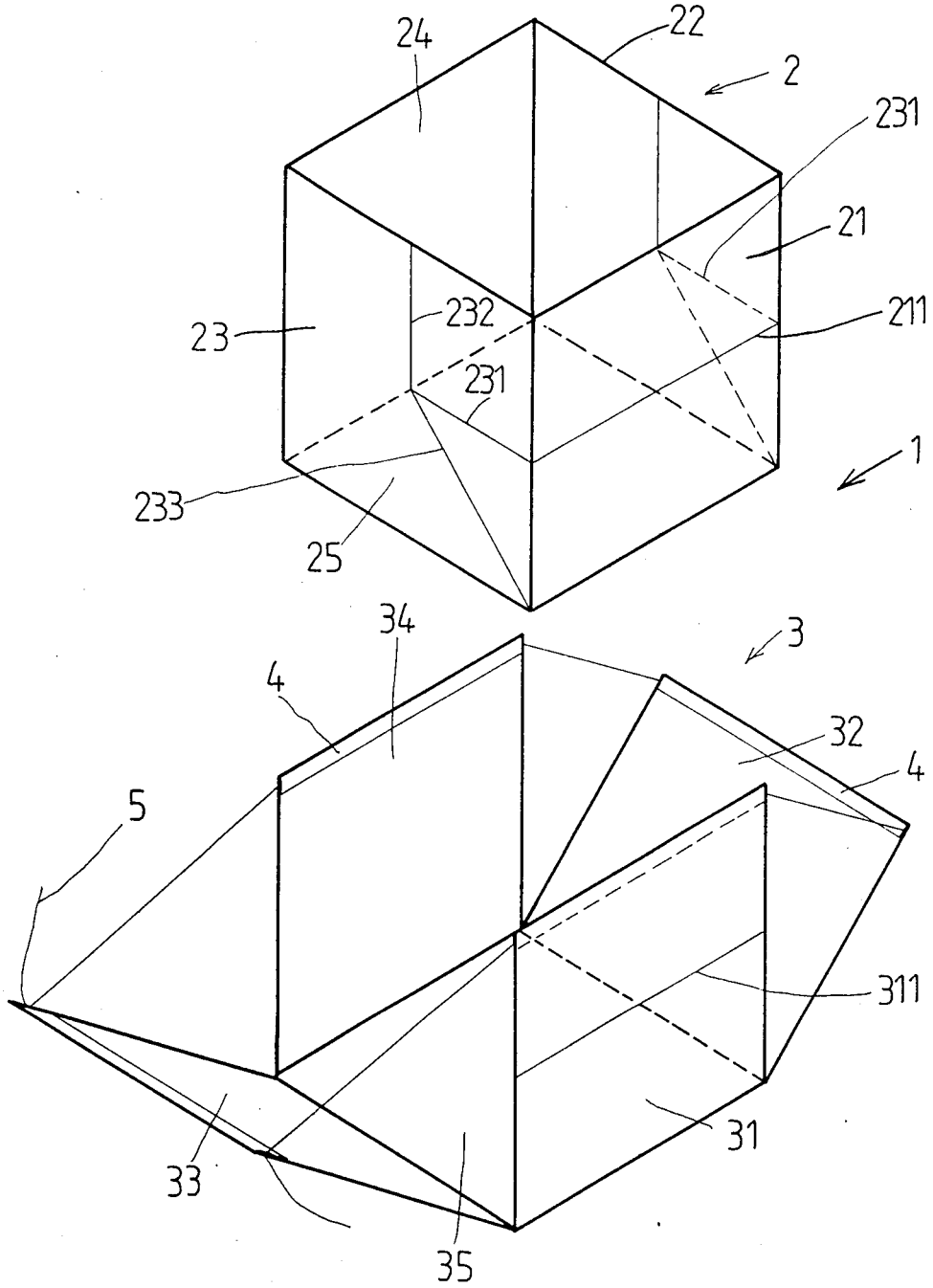
FIG. 1 is an exploded view of a disposable container according to the present invention.

With reference to the drawings and in particular to FIG. 1 thereof, the disposable container 1 according to the present invention comprises an inner cup 2 and an outer cup 3. The inner cup 2 has a vertical front wall 21, a vertical rear wall 24, two vertical side walls 22 and 23, and a bottom 25. The vertical front wall 21 has a horizontal folding line 211 at the middle thereof each of the vertical side walls 22 23 has a horizontal folding line 231 with one end connecting to the folding line 211 of the vertical front wall and the other end connecting to the center thereof, a vertical folding line 232 extending from the center to the upper edge thereof, and tweo slanting folding lines 233 extending from the center to respective lower corners thereof. Consequently, the inner cup 2 can be folded up into a sheet.

The outer cup 3 has a bottom plate 35, a front flap 31, a rear flap 34 and two side flaps 32 and 33 which are formed integral with respective sides of the bottom plate 35. The upper edge of each flap is provided with a passage 4. A pulling line 5 is in turn passed through the passages 4 of the flaps 33, 31, 33, 34, and 33 so that when the pulling line 5 is pulled tight, the flaps will be lifted up to form a container. The outer cup 3 is so designed that it can adapt to the inner cup 2 to form a whole container. Further, the front flap 31 has a horizontal folding line 311 at the middle thereof, which is coincide with the horizontal folding line 211 of the vertical front wall 21 of the inner cup 2.

The vertical front wall 21, the vertical rear wall 24 and the bottom 25 of the inner cup 2 are respectively adhered to the front flap 31, the rear flap 34 and the bottom plate 35 of the outer cup 3.

Figure 2:
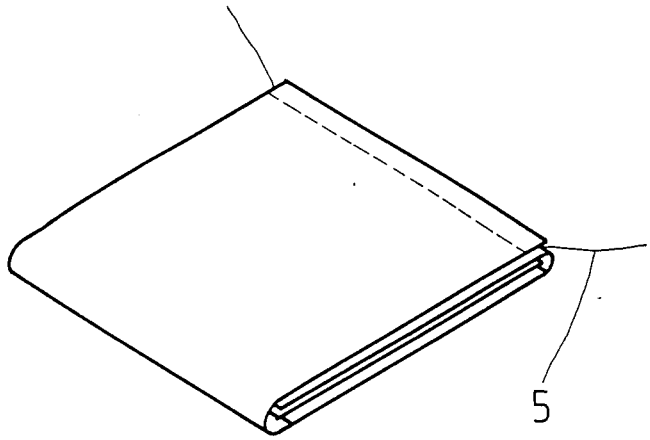
FIG. 2 is a perspective view showing the collapsed state of the disposable container.
Figure 3:
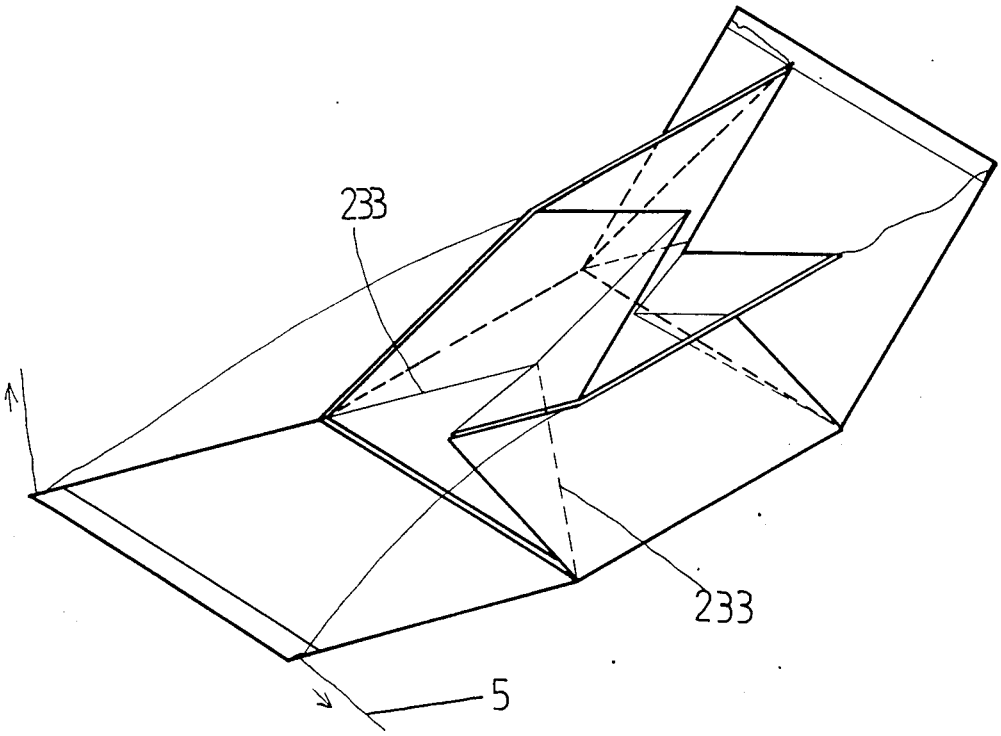
FIG. 3 shows the open state of the disposable container.
Figure 4:
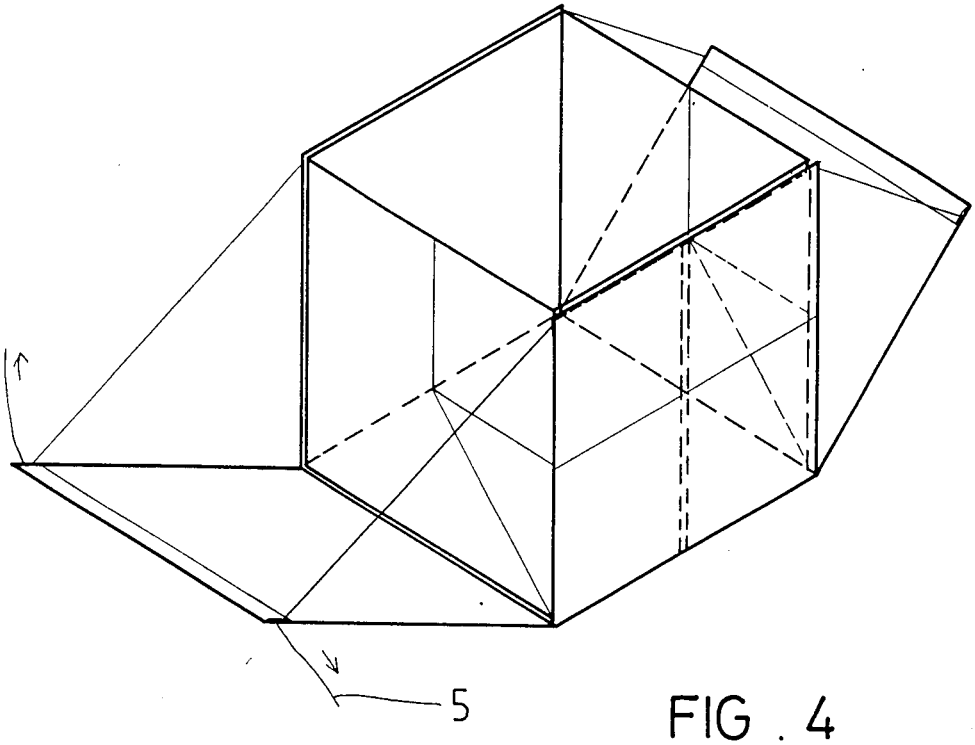
FIG. 4 shows the disposable container being pulled open.

FIG. 2 shows the collapsed state of the disposable container 1 according to the present invention. FIGS. 3 and 4 show how to pull open the disposable container.

Figure 5:
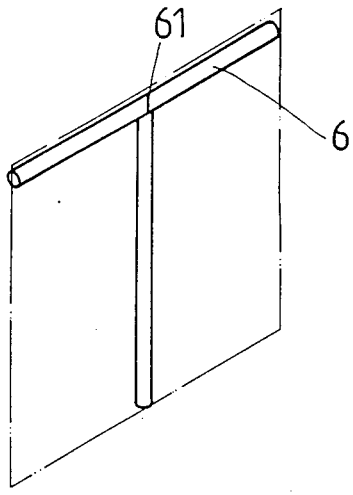
FIG. 5 shows a means for use as a mouth for the disposable container.
Figure 6:
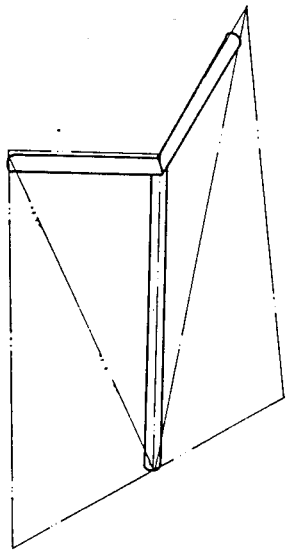
FIG. 6 shows how the means is folded to form a mouth of the disposable container.

Referring to FIGS. 5 and 6, a T-shaped frame 6 which is preferably made of metal or the like is mounted between the vertical front wall 21 ot he inner cup 2 and the front flap 31 of the outer cup 3. The T-shaped frame 6 has at the middle thereof a folding line 61 by which the vertical front flap 31 of the inner cup 2 together with the front flap 31 of the outer cup 3 can be folded to form a mouth.

As described above, the disposable container according to the present invention can be folded into a sheet thereby reducing the transportation cost as well as facilitating the conveyance thereof.

Although this invention has been described with a certain degree of particularity, it is understood that the present disclosure is made by way of example only, and that numerous changes in the detail of construction and the component parts may be resorted to without departing from the spirit and scope of the invention as hereinafter claimed.

I claim:

1. A disposable container comprising:

an inner cup having a vertical front wall, a vertical rear wall, two vertical side walls and a bottom, said vertical front wall having a horizontal folding line at middle thereof, each of said vertical side walls having a horizontal folding line with one end connecting to the horizontal folding line of the vertical front wall and the other end connecting to center thereof, a vertical folding line extending from the center to an upper edge thereof, and two slanting folding lines extending from the center to respective lower corners thereof;

an outer cup having a bottom plate, a front flap, a rear flap and two side flaps, the flaps being integral with respective sides of the bottom plate, said flaps having an upper edge provided with a passage, said front flap having a horizontal folding line at middle thereof which coincides with the horizontal folding line of the vertical front wall of the inner cup, the inside surface of the front flap, the rear flap and the bottom plate of the outer cup being respectively adhered to outside surface of the vertical front wall, the vertical rear wall and the bottom of the inner cup;

a pulling line in turn passing through the passages of one of the side flaps, the front flap, the other one of the side flaps, the rear flap, and the first one of the side flaps.

2. A disposable container as claimed in claim 1 further comprising a T-shaped frame mounted between the vertical front wall of the inner cup and the front flap of the outer cup.

* * * * *